US012123190B2

(12) United States Patent
Hwang et al.

(10) Patent No.: US 12,123,190 B2
(45) Date of Patent: Oct. 22, 2024

(54) BREAKAWAY-PREVENT TROLLEY FOR FLEXIBLE RETRACTABLE STRUCTURE AND TROLLEY SYSTEM HAVING THE SAME

(71) Applicant: UNIVERSITY OF SEOUL INDUSTRY COOPERATION FOUNDATION, Seoul (KR)

(72) Inventors: Kyung Ju Hwang, Seoul (KR); Yun Jin Kim, Bucheon-si (KR); Alexander Hub, Stuttgart (DE)

(73) Assignee: University of Seoul Industry Cooperation Foundation, Seoul (KR)

( * ) Notice: Subject to any disclaimer, the term of this patent is extended or adjusted under 35 U.S.C. 154(b) by 376 days.

(21) Appl. No.: 17/624,719

(22) PCT Filed: Jul. 3, 2020

(86) PCT No.: PCT/KR2020/008700
§ 371 (c)(1),
(2) Date: May 25, 2022

(87) PCT Pub. No.: WO2021/002716
PCT Pub. Date: Jan. 7, 2021

(65) Prior Publication Data

US 2022/0341166 A1 Oct. 27, 2022

(30) Foreign Application Priority Data

Jul. 4, 2019 (KR) ..... 10-2019-0080869

(51) Int. Cl.
*E04B 7/14* (2006.01)
*E04B 7/16* (2006.01)
(Continued)

(52) U.S. Cl.
CPC ..... *E04B 7/18* (2013.01); *E04B 7/16* (2013.01); *E04B 7/14* (2013.01); *E04B 7/166* (2013.01); *E04H 15/64* (2013.01)

(58) Field of Classification Search
CPC ..... E04B 7/18; E04B 7/16; E04B 7/14; E04B 7/166; E04H 15/64; E04H 15/46; E04H 15/48; E06H 15/44
See application file for complete search history.

(56) References Cited

U.S. PATENT DOCUMENTS

2013/0327591 A1* 12/2013 Galpin ..... A62B 35/0062 182/15
2014/0223661 A1* 8/2014 Galloway ..... A61G 7/1078 5/85.1
(Continued)

FOREIGN PATENT DOCUMENTS

DE 2126004 A1 * 5/1971
EP 0007580 A1 * 6/1980
(Continued)

*Primary Examiner* — Phi D A
(74) *Attorney, Agent, or Firm* — Rabin & Berdo, P.C.

(57) ABSTRACT

Provided is a breakaway-prevent trolley system for a flexible retractable structure, including a plate that supports a cable, and a trolley that is movable on the cable and folds or unfolds a flexible film. The trolley includes: a slider movable along the cable; a flexible film coupling member provided under the slider and coupled to the flexible film; an elastic module (E) provided inside the slider. The elastic module includes: an elastic block including a spring therein and moving under an elastic force of the spring by a predetermined distance in a vertical direction; and an upper support plate that supports the elastic block from above, a side support-plate that supports the elastic block from a side, and a lower support plate that supports the elastic block from below, and a lower surface of the elastic block vertically movable while in contact with an upper surface of the plate.

6 Claims, 10 Drawing Sheets

(51) Int. Cl.
*E04B 7/18* (2006.01)
*E04H 15/64* (2006.01)

(56) References Cited

U.S. PATENT DOCUMENTS

| | | | | |
|---|---|---|---|---|
| 2015/0014509 | A1* | 1/2015 | McKay | F16L 3/01 248/62 |
| 2015/0059611 | A1* | 3/2015 | Brown | B61H 1/00 29/428 |
| 2016/0021902 | A1* | 1/2016 | Winkelmolen | A22C 21/06 452/183 |
| 2016/0280238 | A1* | 9/2016 | Zamorano Morfín | B61B 1/00 |
| 2016/0286987 | A1* | 10/2016 | Li | B65G 35/06 |
| 2017/0050646 | A1* | 2/2017 | Blengini | B61B 7/06 |
| 2017/0129748 | A1* | 5/2017 | Patel | B66C 11/24 |
| 2020/0230005 | A1* | 7/2020 | Hidler | A61G 7/1042 |
| 2020/0239034 | A1* | 7/2020 | Erharter | B61B 7/04 |
| 2020/0239111 | A1* | 7/2020 | Zijlmans | B63B 27/14 |
| 2021/0040792 | A1* | 2/2021 | Ashelin | E04B 2/74 |
| 2021/0123277 | A1* | 4/2021 | Garry | E05D 15/0652 |

FOREIGN PATENT DOCUMENTS

| | | | |
|---|---|---|---|
| JP | H0248262 | A | 2/1990 |
| KR | 101371770 | B1 * | 3/2014 |
| KR | 1020190051590 | A | 5/2019 |
| KR | 102053905 | B1 | 12/2019 |

* cited by examiner

BREAKAWAY-PREVENT TROLLEY FOR FLEXIBLE RETRACTABLE STRUCTURE AND TROLLEY SYSTEM HAVING THE SAME

CROSS-REFERENCE TO RELATED APPLICATIONS

This application claims priority under 35 U.S.C § 119 to Korean Patent Application No. 10-2019-0080869 filed in the Korean Intellectual Property Office on Jul. 4, 2019, the entire contents of which are hereby incorporated by reference.

TECHNICAL FIELD

The present disclosure relates to a trolley applicable for a flexible retractable structure, and more particularly, to a trolley for a flexible retractable structure, which is configured to retractably drive a flexible film of a roof structure while the film is hung by a cable, and is also prevented from oscillating up-down, and left-right directions to enable stable retracting operations.

BACKGROUND ART

Unlike general roofs that are fixed, a retractable roof for a structure of a facility is retractably movable. Accordingly, it is a priority to select the type of retraction that can meet the conditions required in terms of architectural planning and structural planning. The retraction types of the currently available retractable roofs are largely divided into a rigid panel method and a flexible film material method, depending on how the retractable surfaces are configured The flexible film material method is a method of hanging a flexible film by cables and retracting the flexible film by folding the same. In this case, a trolley is required to hang the flexible film by the cables and fold the same. There are a plurality of such trolleys arranged in a row and anchored at the cables and pulled by a tractor to be moved. It is necessary that, for folding operation, the flexible film is stably hung from the cables without being eccentrically positioned. The trolley is divided into a part that wraps steel cables and passes on the same with minimal friction, and a disk plate that holds the flexible film material at lower end. In addition, a plurality of trolleys are arranged, with each of the trolleys being moved on the cables by a pulling force of a tractor that is moved by a driving force generated by driving a motor and transmitted thereto An example of the background technology of the present disclosure can be found in Korean Patent Laid-open No. 10-2019-0051590. The related art mentioned above discloses a channel-type steel coupling provided in a trolley as a trolley of a flexible retractable structure. However, the above related art has a problem in that it lacks a structure for stably supporting the trolley on the cables to prevent a breakaway from the cables in the process of retracting the flexible film material.

The respective trolleys are moved on the cables by the pulling force of the tractor, and at this time, the behaviors of the trolleys on the cables are subjected to external force acting in the direction perpendicular or oblique to the direction of travel due to external impact in addition to the pulling force of the tractor, and as a result, the trolleys are oscillated up-down and left-right directions on the cables. However, the trolleys according to the related art are not sufficiently prepared for the up-down and left-right oscillations described above, so there is a risk of breakaway of the trolleys from the cables.

SUMMARY OF INVENTION

Technical Problem

An object of the present disclosure is to provide a structure capable of preventing trolleys from oscillating due to external force when the trolleys are moved on the cables by the tractor or anchored on the plate.

In addition, an object of the present disclosure is to secure structural stability of the trolley by adopting an appropriate material for the same in consideration of the elastic modulus and strength of the member used on the contact surface between the cables and the trolley.

Solution to Problem

The present disclosure provides a breakaway-prevent trolley system for a flexible retractable structure, including a plate that supports a cable, and a trolley that is movable on the cable and folds or unfolds a flexible film, in which the trolley includes: a slider 100 movable along the cable while in contact with the same; a flexible film coupling member 200 provided under the slider and coupled to the flexible film; an elastic module (E) provided inside the slider, and the elastic module includes: an elastic block 10 including a spring therein and moving under an elastic force of the spring by a predetermined distance in a vertical direction; and an upper support plate 11 that supports the elastic block from above, a side support plate 12 that supports the elastic block from a side, and a lower support plate 13 that supports the elastic block from below, and a lower surface of the elastic block is provided to be vertically movable while in contact with an upper surface of the plate.

The elastic block includes: a block hole (10-1) formed vertically on an upper surface of the elastic block 10; and a support 17 coupled, at an upper end, to the upper support plate, and inserted into the block hole; a spring 18 inserted into the block hole while enclosing the support.

An elastic gap (d) is defined between the upper surface of the elastic block and the upper support plate 11 due to the elastic force of the spring, a width of the lower support plate 13 is formed to be smaller than a width of the lower surface of the elastic block 10, such that the lower surface of the elastic block is not supported by the lower support plate 13 and is exposed to form an exposed lower surface portion **10*a*, and the elastic block is moved upward as the exposed lower surface portion 10*a*** of the elastic block comes into contact with the upper surface of the plate.

The plate includes: a cable connection part 310; a vertical pivoting part 320 pivotably connected to the cable connection part 310; and a horizontal part 330 integrally formed with the vertical pivoting part 320, and the plate includes: rail surfaces 340 formed along a length direction of the cable at both outer ends of an upper surface of the horizontal portion 330; and rail inclined surfaces 345 formed on front and rear sides of the rail surfaces In addition, the present disclosure provides a trolley including a breakaway-prevent elastic block 10 inside a slider moved along a cable, in which the elastic block includes: a block hole (10-1) formed vertically on an upper surface of the elastic block; a support 17 inserted in the block hole; and a spring 18 inserted into the block hole while enclosing the support. in which, when the lower surface of the elastic block receives a force in the upward direction during the movement of the slider, the elastic block is movable upward.

Advantageous Effects of Invention

According to the present disclosure configured as described above, with the structure of the elastic module provided inside the trolley, there is an advantageous effect that the trolley can not only be moved stably on the cable, but also effectively buffer against the external force in the direction perpendicular to the cable exerted by the flexible film after the trolley is anchored at the plate, and accordingly, it is possible to prevent a breakaway of the trolley and maintain a stable state.

BEST MODE FOR CARRYING OUT THE INVENTION

The objectives, specific advantages and novel features of the present disclosure will become more apparent from the following detailed description and the preferred embodiments, which are associated with the accompanying drawings. In addition, terms described herein are terms defined in consideration of functions in the present invention, which may vary according to the intention or convention of a user or an operator. Therefore, definitions of these terms should be made based on the contents throughout the present specification.

Figure 1:
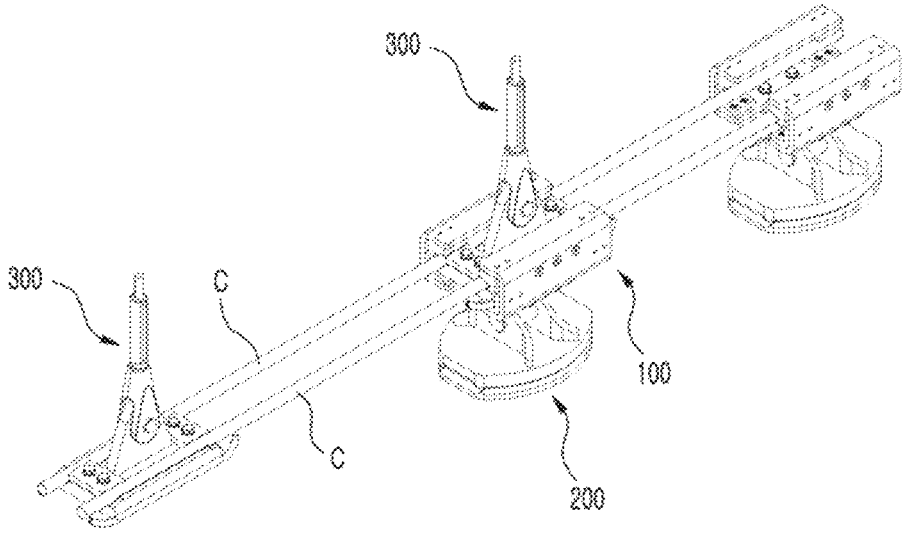
FIG. 1 is a perspective view of a breakaway-prevent trolley system for a flexible retractable structure according to the present disclosure.
Figure 2:
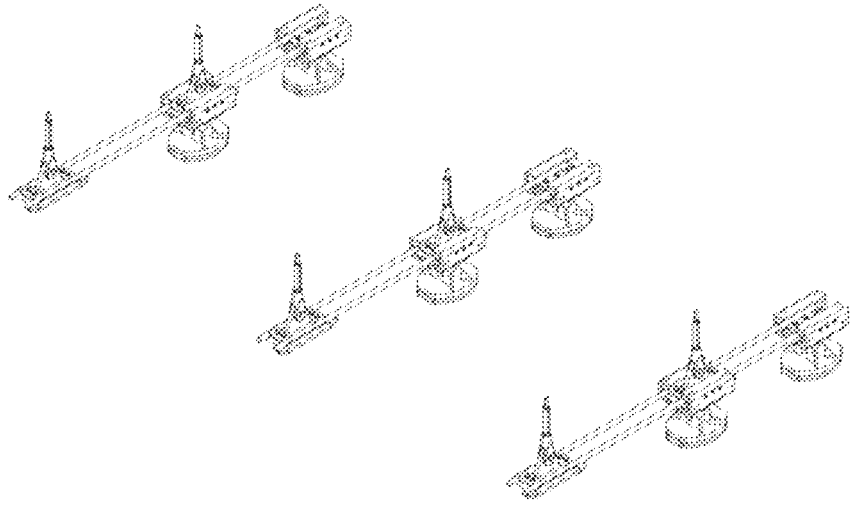
FIG. 2 illustrates breakaway-prevent trolleys for a flexible retractable structure positioned on a plurality of cables arranged in a transverse direction according to the present disclosure.
Figure 3:
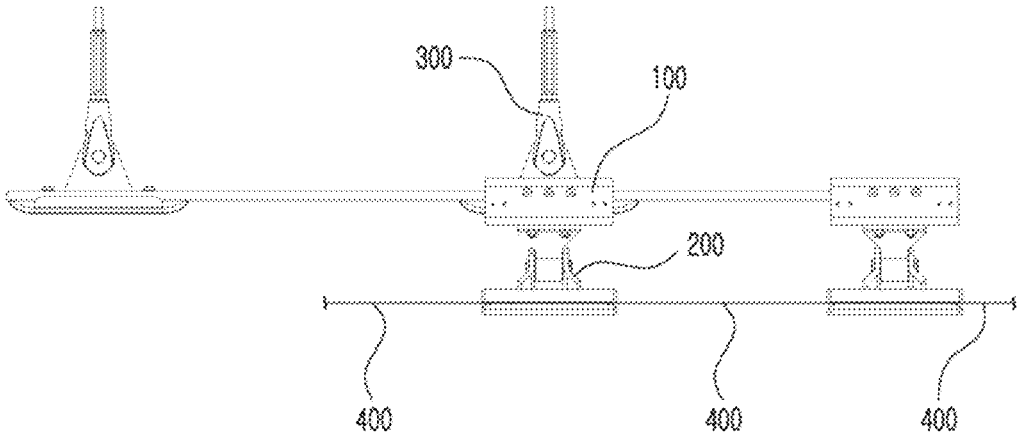
FIG. 3 is a front view of the trolley system shown in FIG. 1.
Figure 4:
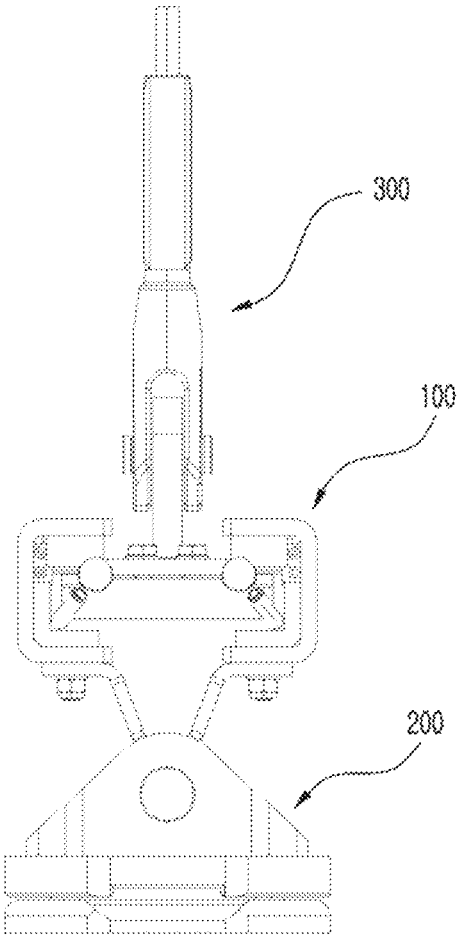
FIG. 4 is a vertical cross-sectional view of a breakaway-prevent trolley for a flexible retractable structure according to the present disclosure.
Figure 5:
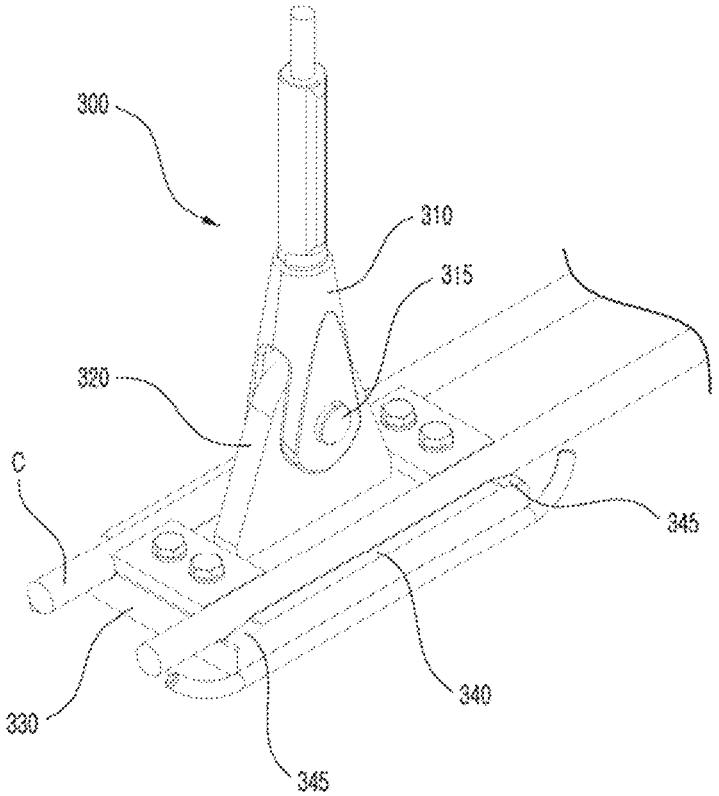
FIGS. 5 and 6 illustrate only a part of the breakaway-prevent trolley system for a flexible retractable structure according to the present disclosure.
Figure 6:
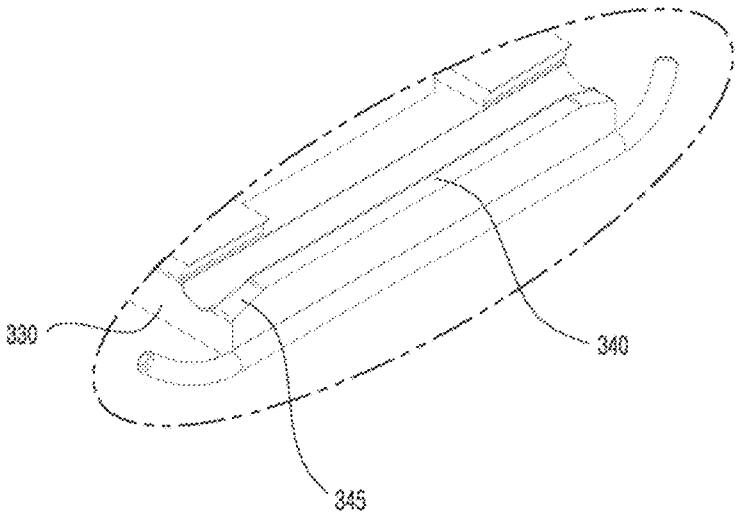
Figure 7:
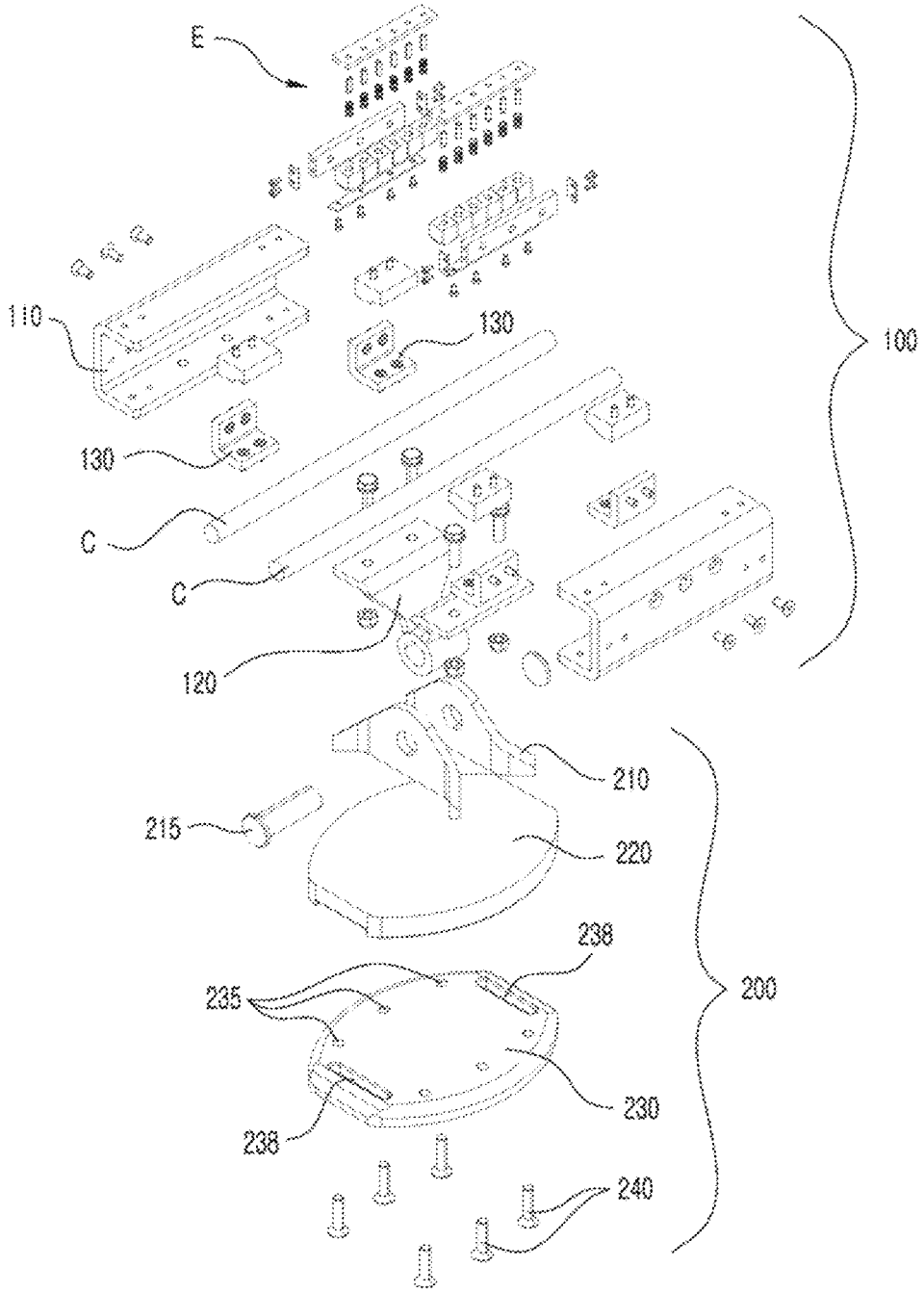
FIG. 7 is an exploded perspective view of the trolley according to the present disclosure.
Figure 8:
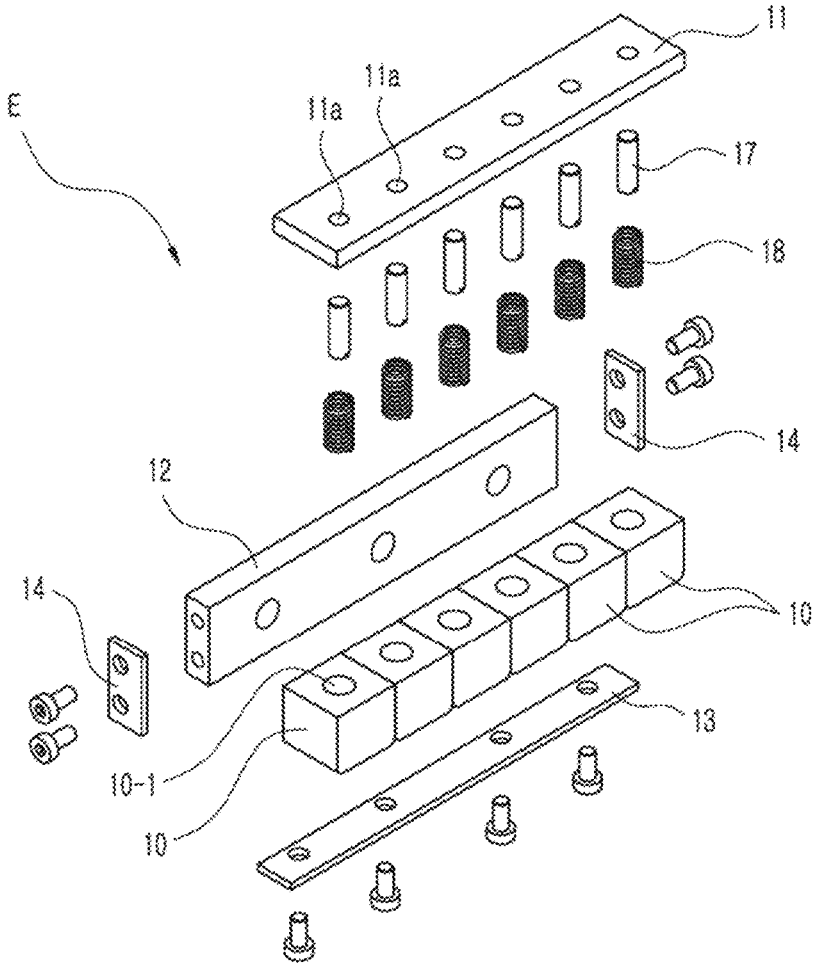
FIG. 8 is an exploded perspective view of a part of the configuration illustrated in FIG. 7, which is the elastic module of the present disclosure.
Figure 9:
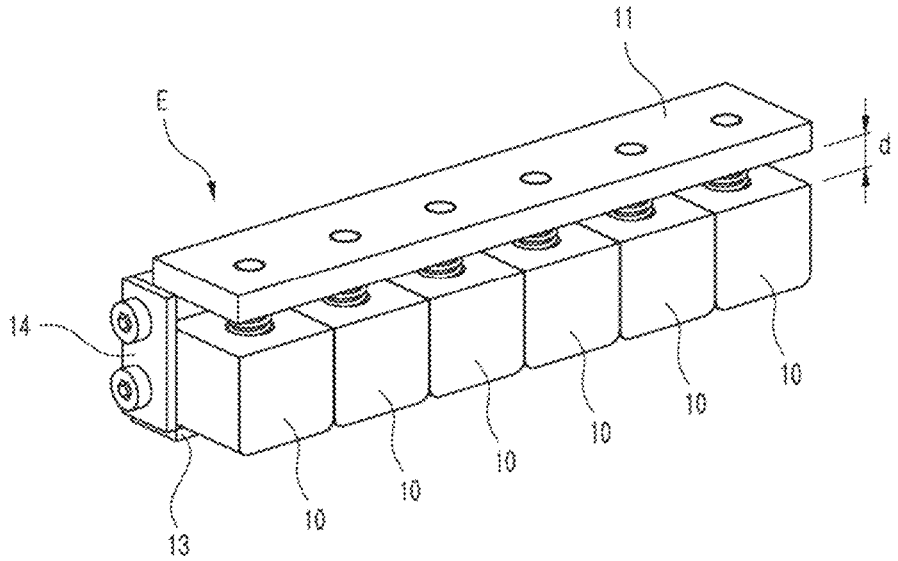
FIG. 9 is an elastic module of the present disclosure.
Figure 10:
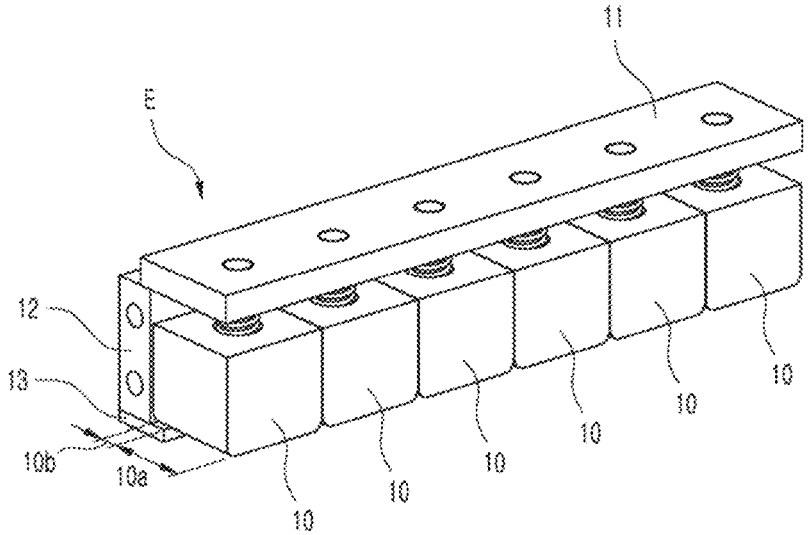
FIG. 10 illustrates the elastic module of FIG. 9 from which some components are removed.
Figure 11:
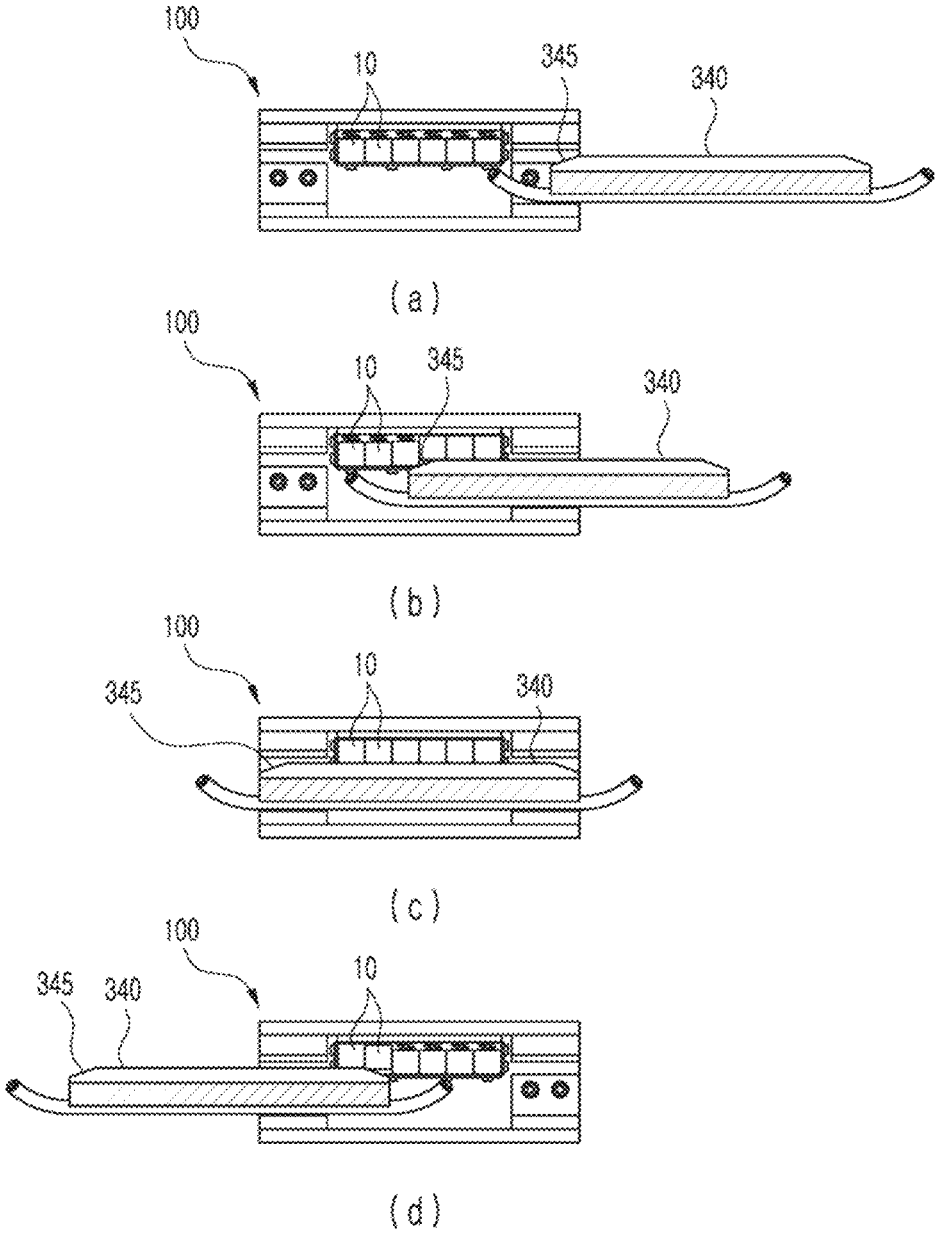
FIG. 11 illustrates the breakaway-prevent trolley system for a flexible retractable structure moving and acting as a buffer according to the present disclosure.
Figure 12:
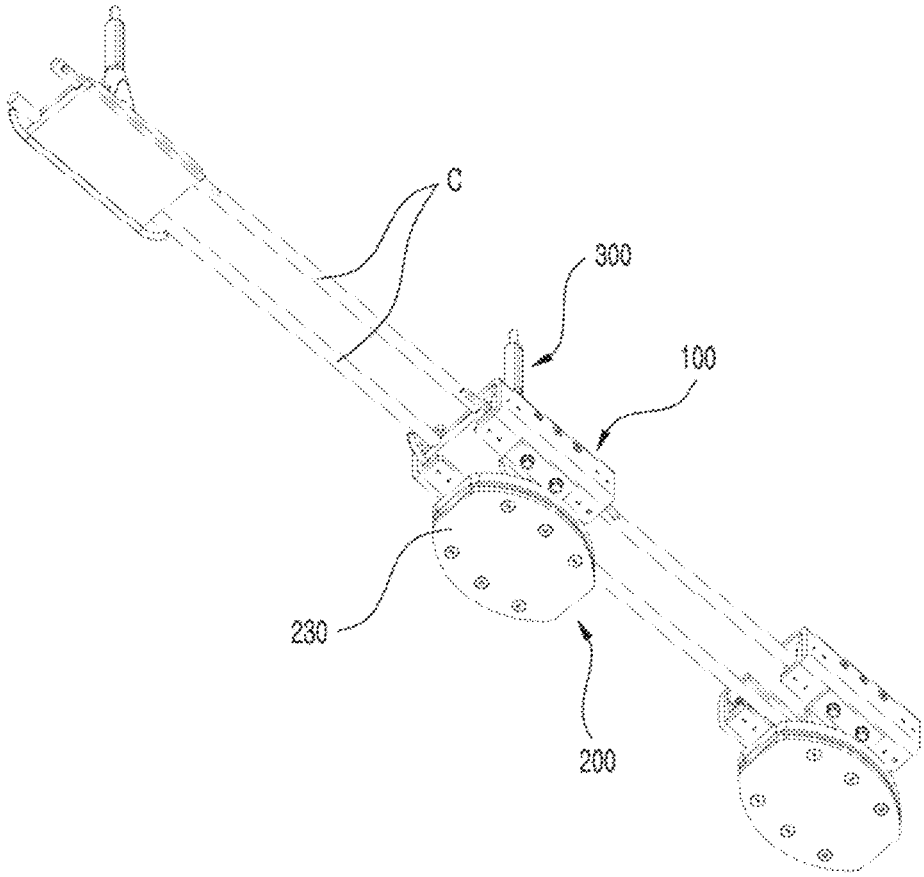
FIG. 12 illustrates the trolley system illustrated in FIG. 1 from below.

FIG. 1 is a perspective view of a breakaway-prevent trolley system for a flexible retractable structure according to the present disclosure, FIG. 2 illustrates breakaway-prevent trolleys for a flexible retractable structure positioned on a plurality of cables arranged in a transverse direction according to the disclosure, FIG. 3 is a front view of the trolley system shown in FIG. 1, FIG. 4 is a vertical cross-sectional view of a breakaway-prevent trolley for a flexible retractable structure according to the present disclosure, FIGS. 5 and 6 illustrate only a part of the breakaway-prevent trolley system for a flexible retractable structure according to the present disclosure, FIG. 7 is an exploded perspective view of the trolley according to the present disclosure, FIG. 8 is an exploded perspective view of a part of the configuration illustrated in FIG. 7, which is the elastic module of the present disclosure, FIG. 10 illustrates the elastic module of FIG. 9 from which some components are removed, FIG. 11 illustrates the breakaway-prevent trolley system for a flexible retractable structure, acting as a buffer while moving according to the present disclosure, and FIG. 12 illustrates the trolley system illustrated in FIG. 1 from below.

The trolley according to the disclosure is a device fastened to a film of a retractable roof to fold and unfold the film when retracting the roof, and includes, at a lower end of the trolley, a flexible film coupling member in the shape of a disk plate so as to be bonded with a flexible film.

Referring to FIGS. 1 to 6, the trolleys 100, 200 according to the present disclosure include a slider 100 on upper side and a flexible film coupling member 200 on lower side. A plurality of trolleys are arranged along cables (C) and structured to suspend a flexible film 400 by the flexible film coupling members positioned on the lower side (FIG. 3). The flexible film is a film material serving as a roof of a structure of a facility and is structured to open the roof according to the movement of the trolley. The neighboring trolleys arranged adjacent to each other on one cable (C) are connected to each other with a traction cable (not illustrated) such that, when a tractor (not illustrated) pulls the outer trolley positioned at a position closest to the outside, the trolleys are sequentially towed one by one by the traction cable. As the trolleys are towed sequentially, the flexible film 400 attached thereunder is unfolded. In addition, the cables are arranged in pair as illustrated in FIG. 1, and the slider 100 of the trolley is moved on the cables arranged in pair. In addition, a plurality of pairs of cables are arranged in a transverse direction to support the flexible film as a whole (see FIG. 2).

At this time, as the trolleys are moved on the cables (C) fixed in position by the pulling force of the tractor, the behavior of the trolleys on the cables is subjected to external force acting in the direction perpendicular or oblique to the direction of travel due to external impact in addition to the pulling force of the tractor, and as a result, the trolleys are shaken up, down, left and right on the cables. The present disclosure is provided to prevent the trolleys from breaking away from the cables and to enable stable movement, by providing a buffering structure to buffer the up-down and left-right oscillating of the trolleys described above.

The structure of a plate 300 of the present disclosure will be described with reference to FIGS. 4 to 6.

In a flexible retractable trolley system, cables for plate (not illustrated), which are provided for hanging the plates 300, are arranged above and along the cables (C). That is, the plate 300 is hung by the cable for plate (not illustrated), while being fixed at a certain point. The plate includes a cable connection part 310 connected to the cable for plate, a vertical pivoting part 320 pivotably connected to the cable connection part 310, and a horizontal part 330 integrally formed with the vertical pivoting part 320. In addition, a seating groove for the cable (C) to be seated therein is provided on an upper surface of the horizontal portion 330, and the cable (C) positioned in the seating groove is integrally coupled with the horizontal portion 330. The vertical pivoting part is rotatably coupled to the cable connection part by a pivoting shaft 315.

Through this, the plate 300 is connected to the cable for plate to be secured against left and right linear movement, and the plate 300 is integrally coupled with the cable (C) to serve to fix and support the cable (C). Rail surfaces 340 are positioned at both ends (outside of the cable (C)) of the upper surface of the horizontal portion 330, and rail inclined surfaces 345 are formed on front and rear sides of the rail surfaces 340 and these are portions to be in contact with the member of the slider 100 of the trolley to be described below.

[Elastic Module Structure for Breakaway Prevention]

The structure of the elastic module of the trolleys 100, 200 of the present disclosure will be described with reference to FIGS. 7 to 10. As described above, the trolley according to the present disclosure includes the slider 100 positioned on upper side and moving along the cables (C), and the flexible film coupling member 200 positioned on lower side and holding the flexible film 400

The slider 100 includes left and right slider bodies 110 formed in a C shape on both sides and spaced apart from each other, and a slider coupling member 120 that connects the left and right slider bodies 110 to each other from below. In addition, the slider bodies 110 include therein various parts 130, bolts, and so on for coupling members such as the elastic module (E) to be described below.

The present disclosure adopts the elastic module (E) including elastic blocks 10 that are elastically movable up and down so as to ensure that, when the trolley is anchored on the plate 300, the trolleys are stably anchored.

The elastic module (E) of the present disclosure includes an upper support plate 11 for supporting each of the elastic blocks 10 from above, a side support plate 12 for supporting from the outer side, and a lower support plate 13 for supporting from below, and auxiliary support plates 14 are coupled to both ends of the side support plate. The upper support plate, the side support plate, the lower support plate, the auxiliary support plates, and the like are fastened with bolts through bolt holes formed in each support plate as shown in the drawing, and since such a bolt fastening means is a part commonly used in the field of mechanical elements, a detailed description thereof will be omitted.

The elastic blocks 10 are positioned inside the approximately C shaped structure of the elastic module, which is configured with the upper support plate 11, the side support plate 12, and the lower support plate 13. FIG. 10 illustrates the elastic module (E) of FIG. 9 from which only the auxiliary support plates 14 are removed for better understanding. The lower surfaces of the elastic blocks are supported by the lower support plate 13. However, this is not a structure that the lower surfaces of the elastic blocks are supported entirely by the lower support plate 13, and rather, this is a structure that the blocks are only partially supported (see the area 10*b* in FIG. 10). That is, since the width of the lower support plate 13 supports only a part of the lower surfaces of the elastic blocks 10, certain portion of the lower surfaces of the elastic blocks is not supported by the lower support plate 13 and is exposed to form an exposed lower surface portion 10*a* (FIG. 10). The exposed lower surface portion 10*a* is moved in contact on the rail surface (340 in FIG. 6) of the plate 300 described above.

When viewing from the side of the elastic module (E), the elastic blocks 10 are positioned inside the approximately C-shaped structure, and an elastic gap (d) is formed between the elastic blocks 10 and the upper support plate 11. Then, vertically-formed block holes 10-1 are formed on the upper surface of the elastic blocks 10, and supports 17 and springs 18 are inserted into the block holes. The supports 17 are positioned within the springs and serve to prevent buckling of the springs, and upper ends of the supports are coupled, or preferably welded, to upper fastening holes 11*a* formed in the upper support plate 11. With the upper ends of the springs 18 touching the upper support plate 11 and the lower ends of the springs touching the bottoms of the block holes 10-1, the springs 18 serve to exert an elastic force so that the elastic blocks 10 maintain the elastic distance (d) from the upper support plate 11. With this structure, the elastic blocks 10 are moved vertically and reciprocally while being supported by the support 17, the lower support plate 13, and the like The elastic module is coupled inside the slider 100 of the trolley. That is, the upper support plate 11, the side support plate 12, the lower support plate 13, and the like are integrally fixed inside the slider 100. In this state, the elastic blocks 10 are movable up and down while being supported by the springs 18 by the elastic interval (d).

FIG. 11 illustrates the breakaway-prevent trolley system for a flexible retractable structure moving and acting as a buffer according to the present disclosure.

In the process of the trolley being moved on the cables (C) and anchored on the plate 300, as the elastic module (E) comes into contact with the plate 300, the exposed lower surface portion 10*a* of the elastic blocks 10 comes into contact with the rail inclined surface 345 positioned in the front side of the rail surface 340 of the plate 300, such that the springs 18 are compressed and the elastic blocks 10 are slightly moved upward. In addition, when the elastic blocks are positioned inside the plate, the elastic blocks are positioned on the rail surface 340 of the plate and the springs 18 are in compressed state (FIGS. 11A, 11B and 11C).

In addition, when the trolley is moved on the cables (C) and passes through the plate 300, the exposed lower surface portion 10*a* of the elastic blocks 10 is released from the rail surface 340 of the plate 300, and the elastic blocks are moved back downwardly by the elastic force of the spring (FIG. 11D).

As the trolley of the present disclosure is moved along the cables, the flexible film unfolds and in this unfolded state of the flexible film, the trolley is anchored at the plate 300 and maintained in a state of not moving along the cables, as is illustrated in FIG. 11C.

When the trolley is anchored at the plate, with the exposed lower surface portion 10*a* of the elastic block 10 coming into contact with the rail surface portion 340 of the plate 300, the elastic blocks 10 are moved slightly upward by the compression of the springs 18, and in this state, the elastic force exerted by the springs urges the exposed lower surface of the elastic block into contact with the rail surface 340 of the plate. In addition, at this time, an external force (external force in the vertical direction with respect to the cable) may act on the trolley by the flexible film.

Figure 13:
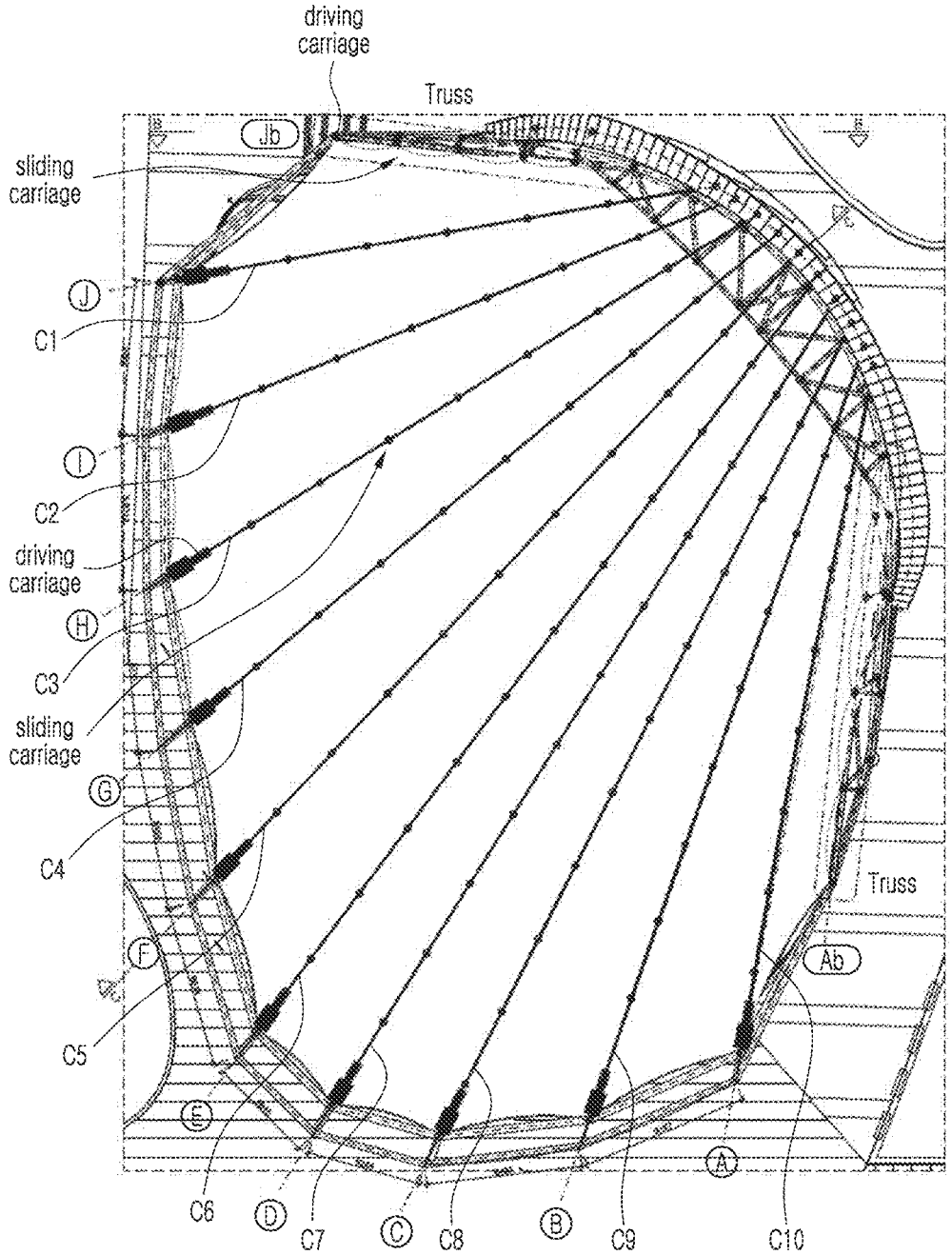
FIG. 13 shows a flexible film of a flexible retractable structure in an unfolded state according to the present disclosure.

The external force in the vertical direction of the cable acting on the trolley by the flexible film, is very evident by referring to the unfolded state of the asymmetric flexible film as illustrated in FIG. 13. In this example, "asymmetric" means that the lengths of the cables (C) on the upper side of the flexible film in the retracting structure of the flexible film are different from each other and thus are not symmetrical. In the drawing, 10 cables are illustrated as an example, and numbered as C1, C2 to C9, and C10, respectively. That is, among the cables disposed on the flexible film as illustrated in FIG. 13, the cables C5, C6, and C7 disposed at the center position are relatively long, and the cables C1, C2, C9, and C10 disposed at the outer sides are relatively short.

Regarding the process of the flexible film unfolding from a folded state, the trolleys start to drag and unfold the flexible film at the same time on each cable, and the trolleys on the cables C1, C2, C9, and C10 with a relatively shorter length on the outer sides finish the unfolding operation faster. In this state, the trolleys on the cables C5, C6, and C7 positioned in the center continue to advance, and at this time, the outer flexible film exerts force on the central flexible film. That is, the flexible film under the outer trolleys pulls the flexible film under the central cables C5, C6, and C7, and as a result, the force is transmitted to below the trolleys of the central cables C5, C6, and C7, and acts as an external force (external force in the vertical direction with respect to the cable) on the trolleys mentioned above.

Even with the external force acts on the trolleys, the lower surfaces of the elastic blocks of the elastic module of the trolley are continuously in contact with the rail surface of the plate by the elastic force of the springs. Therefore, according to the present disclosure, even when the external force is applied while the trolleys are anchored at the plate, the action of the elastic module of the present disclosure described above prevents a breakaway of the trolleys.

[Coupling Structure to Increase Durability of Flexible Film]

In addition, a lower portion of the slider coupling member 120 is connected to the flexible film coupling member using a coupling shaft 215 and a vertical plate 210. The flexible film coupling member 200 includes an upper plate 220, a lower plate 230, and bolts 240 for fastening the upper plate and the lower plate. Then, the flexible film 400 is positioned between the upper plate 220 and the lower plate 230, and the upper and lower plates are firmly fastened with the bolts 240. Bolt holes 235 for bolting are positioned in the lower plate. According to the present disclosure, there is an effect that the lower surface of the upper plate 220 and the upper surface of the lower plate 230 press the flexible film 400 as a whole, so that the flexible film and the coupling member are coupled while making surface contact over a large area. Therefore, the durability of the flexible film is significantly increased compared to the related trolley method that holds the flexible film only at specific positions. In addition, by providing a friction member 238 of a thin elastic material in certain area of the lower surface of the upper plate 220 or the upper surface of the lower plate 230, the flexible film can be applied with the force as a whole, and as a result, the durability of the flexible film can be further increased. When the trolleys are moved, the friction is used to allow the flexible film to behave together.

The related flexible film bonding method adopts a form in which a specific member at the end of the trolley is bonded to the film, and such method suffers disadvantage because the force is concentrated at the junction of the film, resulting in the film being damaged in the process of repeated operation over time, which is problematic in the durability of the trolley.

According to the present disclosure, the flexible film is disposed between the disk plate-shaped members such that the film can be held over a larger area, thereby preventing excessive load from being concentrated only on a specific point of the flexible film and thus increasing durability The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

The invention claimed is:

1. A breakaway-prevent trolley system for a flexible retractable structure, comprising: a plate that supports a cable, and a trolley that is movable on the cable and folds or unfolds a flexible film, wherein the trolley comprises:

a slider (100) movable along the cable while in contact with the cable; a flexible film coupling member (200) provided under the slider and coupled to the flexible film; and an elastic module (E) provided inside the slider;

wherein the elastic module includes:

an elastic block (10) including a spring therein and moving under an elastic force of the spring by a predetermined distance in a vertical direction; an upper support plate (11) that supports the elastic block from above, a side support plate (12) that supports the elastic block from a side, and a lower support plate (13) that supports the elastic block from below;

wherein a lower surface of the elastic block is provided to be vertically movable while in contact with an upper surface of the plate; and wherein the plate includes: a cable connection part (310); a vertical pivoting part (320) pivotably connected to the cable connection part (310); a horizontal part (330) integrally formed with the vertical pivoting part (320); rail surfaces (340) formed along a length direction of the cable at both of outer ends of an upper surface of the horizontal part (330); and rail inclined surfaces (345) formed on front and rear sides of the rail surfaces.

2. The breakaway-prevent trolley system according to claim 1, wherein the elastic block includes:

a block hole formed vertically on an upper surface of the elastic block (10); and a support coupled, at an upper end, to the upper support plate, and inserted into the block hole; and wherein the spring is inserted into the block hole and encloses the support.

3. The breakaway-prevent trolley system according to claim 2, wherein an elastic gap (d) is defined between the upper surface of the elastic block and the upper support plate (11) due to the elastic force of the spring.

4. The breakaway-prevent trolley system according to claim 1, wherein a width of the lower support plate (13) is formed to be smaller than a width of the lower surface of the elastic block (10), such that the lower surface of the elastic block is not supported by the lower support plate (13) and is exposed to form an exposed lower surface portion (10*a*).

5. The breakaway-prevent trolley system according to claim 4, wherein the elastic block is moved upward as the exposed lower surface portion (10*a*) of the elastic block comes into contact with the upper surface of the plate.

6. The breakaway-prevent trolley system according to claim 1, wherein a lower surface of the elastic block includes an exposed lower surface portion (10*a*), which is an area not supported by the lower support plate (13) and exposed, and when the trolley is anchored at the plate, the exposed lower surface portion comes into contact with the rail surface (340).

* * * * *